US009604094B2

(12) United States Patent
Kosyan

(10) Patent No.: US 9,604,094 B2
(45) Date of Patent: Mar. 28, 2017

(54) PORTABLE EXERCISE MACHINE

(71) Applicant: Antranik Kosyan, Aurora, CO (US)

(72) Inventor: Antranik Kosyan, Aurora, CO (US)

( * ) Notice: Subject to any disclaimer, the term of this patent is extended or adjusted under 35 U.S.C. 154(b) by 63 days.

(21) Appl. No.: 14/816,620

(22) Filed: Aug. 3, 2015

(65) Prior Publication Data

US 2016/0136479 A1 May 19, 2016

Related U.S. Application Data

(60) Provisional application No. 62/079,133, filed on Nov. 13, 2014.

(51) Int. Cl.

| | |
|---|---|
| ***A63B 21/02*** | (2006.01) |
| ***A63B 21/00*** | (2006.01) |
| ***A63B 21/045*** | (2006.01) |
| ***A63B 23/035*** | (2006.01) |
| ***A63B 23/12*** | (2006.01) |

(52) U.S. Cl.

CPC ..... *A63B 21/4035* (2015.10); *A63B 21/023* (2013.01); *A63B 21/0455* (2013.01); *A63B 21/4039* (2015.10); *A63B 21/4047* (2015.10); *A63B 23/03533* (2013.01); *A63B 23/1254* (2013.01); *A63B 21/0004* (2013.01)

(58) Field of Classification Search

CPC ..... A63B 21/4035; A63B 21/0442; A63B 21/0557; A63B 21/023; A63B 23/03541; A63B 21/00061; A63B 21/0004; A63B 21/16; A63B 23/0355; A63B 21/4047; A63B 21/4019; A63B 21/02; A63B 21/045

USPC ..... 482/126–129, 121–124

See application file for complete search history.

(56) References Cited

U.S. PATENT DOCUMENTS

| | | | | | |
|---|---|---|---|---|---|
| 2,760,774 | A * | 8/1956 | Perez | A63B 21/023 | 482/79 |
| 3,528,413 | A * | 9/1970 | Aydt | A61F 5/013 | 24/569 |
| 4,259,949 | A * | 4/1981 | Axelsson | A61F 2/54 | 248/118 |
| 4,343,465 | A * | 8/1982 | Allen | A63B 23/129 | 482/123 |
| 4,482,149 | A * | 11/1984 | Weldon | A63B 21/00072 | 482/123 |
| 4,553,747 | A | 11/1985 | Pursley | | |
| 4,641,832 | A * | 2/1987 | Mattox | A63B 21/00065 | 482/114 |

(Continued)

*Primary Examiner* — Andrew S Lo

(74) *Attorney, Agent, or Firm* — Global Intellectual Property Agency, LLC; Daniel Boudwin

(57) ABSTRACT

A portable exercise machine is provided for rotator cuff exercise. The portable exercise machine includes a flat board having an upper surface and a U-shaped cutout for receiving a torso of a user. A pair of opposing, rotatable arms are affixed to the upper surface of the flat board. The distal end of each arm includes a handle adapted to be grasped by a user and the proximal end of each arm is pivotally coupled to a steel coil. The steel coil provides resistance against the rotation of the distal end of the arms. The steel coil can be removably affixed to an inner connection region or an outer connection region of the flat board. The outer connection region provides resistance for inward movement of the arms and the inner connection region provides resistance for outward movement of the arms.

7 Claims, 4 Drawing Sheets

(56) References Cited

U.S. PATENT DOCUMENTS 4,720,100 A * 1/1988 Du Buy ..... A63B 21/0455 482/112
4,772,015 A 9/1988 Carlson et al.
4,809,804 A * 3/1989 Houston ..... A61G 5/125 180/65.51
4,822,027 A * 4/1989 Kascak ..... A63B 23/14 482/130
5,391,132 A * 2/1995 Greenwald ..... A63B 23/03533 482/114
5,580,338 A * 12/1996 Scelta ..... A63B 22/0002 482/114
5,612,718 A * 3/1997 Bryan ..... A47C 7/70 297/115
5,645,521 A 7/1997 Hepburn et al.
5,713,370 A * 2/1998 Cook ..... A61B 5/0488 482/114
6,007,500 A 12/1999 Quintinskie, Jr.
6,342,033 B1 * 1/2002 Walker ..... A63B 21/015 482/114
6,948,502 B2 * 9/2005 Berger ..... A61B 6/0421 128/845
7,699,754 B2 * 4/2010 Schneider ..... A63B 22/0002 482/1
7,731,642 B2 * 6/2010 Kashiwaya ..... A63B 23/1254 482/100
8,012,107 B2 * 9/2011 Einav ..... A61B 5/7475 601/5
8,177,732 B2 * 5/2012 Einav ..... A61H 1/0274 601/23
8,915,871 B2 * 12/2014 Einav ..... A61B 5/1116 601/24
9,248,330 B1 * 2/2016 Ghanem ..... A63B 21/008
2003/0158019 A1 * 8/2003 Giannelli ..... A63B 21/155 482/100
2004/0002407 A1 * 1/2004 Hawkes ..... A61H 3/008 482/69
2007/0219049 A1 * 9/2007 Sheeks ..... A63B 21/15 482/1
2008/0041282 A1 * 2/2008 Goschy ..... A61G 5/10 108/141
2010/0234776 A1 * 9/2010 Borden ..... A61H 1/0281 601/33
2011/0112441 A1 * 5/2011 Burdea ..... A63B 21/06 600/595

* cited by examiner

PORTABLE EXERCISE MACHINE

CROSS REFERENCE TO RELATED APPLICATION

This application claims the benefit of U.S. Provisional Application No. 62/079,133 filed on Nov. 13, 2014. The above identified patent application is herein incorporated by reference in its entirety to provide continuity of disclosure.

BACKGROUND OF THE INVENTION

Field of the Invention

The present invention relates to a portable exercise machine. More specifically, the present invention relates to a portable exercise machine for exercising the rotator cuffs, wherein the exercise machine comprises a flat board having a pair of opposing, rotatable arms affixed to the upper surface of the flat board via a steel coil. The steel coil is removably attached to either an inner connection region or an outer connection region of the flat board to provide inward and outward resistance of the arms.

Rotator cuff muscles are responsible for external and internal rotation of the arm and help to keep the shoulder head in the socket of the shoulder joint. Rotator cuff muscles can lose their strength and tone over time. When this happens, the shoulder head becomes loose and separates from the socket, causing impingement, wear, and eventually a tear in the rotator cuff. Such injuries can be painful and may also limit the movement and functionality of the arm.

Shoulder injury is very common in athletic activity, and especially in activities involving the throwing motion. The repetitious movement of the throwing motion during maximal effort applies a great amount of stress on the four specific rotator cuff muscles involved during the deceleration of the arm. The rotator cuff consists of the fibers which blend with and reinforce the capsule of the shoulder joint. It is of particular importance to athletes to keep these muscles strong because although the degeneration and subsequent tearing of these muscles is a rather common occurrence, the result being restriction of shoulder movement.

Therefore, the present invention contemplates a portable exercise machine that for external and internal rotation of the arm to help maintain and strengthen rotator cuff muscles. Specifically, a user may grasp the handles disposed on each arm and rotate the arms inwardly and outwardly to exercise the rotator cuff muscles. The proximal end of each arm is coupled to a spring which provides resistance for inward and outward movement depending on the location of the spring.

SUMMARY OF THE INVENTION

In view of the foregoing disadvantages inherent in the known types of exercise machines now present in the prior art, the present invention provides a portable exercise machine wherein the same can be utilized for providing convenience for the user when exercising a user's arms, forearms, or rotator cuffs.

It is an object of the present invention to provide a portable exercise machine comprising a flat board including an upper surface. The flat board is planar and substantially rectangular. The flat board includes a U-shaped cutout for receiving a torso of a user.

Another object of the present invention is to provide a portable exercise machine comprising a pair of opposing, rotatable arms affixed to the upper surface of the flat board.

The arms include a handle at a distal end thereof, wherein the handle is cylindrical such that a user can grasp the handle on the arms.

Another object of the present invention is to provide a portable exercise machine including at least one steel coil coupled to a proximal end of each arm. The proximal end of each arm is secured to the flat board by the steel coil. The steel coil provides resistance against the rotation of the distal end of the arms such that user must exert a certain amount of force to rotate the arms.

Yet another object of the present invention is to provide a portable exercise machine wherein the upper surface further includes an inner connection region and an outer connection region. The steel coil can be affixed to the inner connection region or outer connection region via a plurality of fasteners. The inner connection provides resistance for outward movement of the arms and the outer connection provides resistance for inward movement of the arms.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
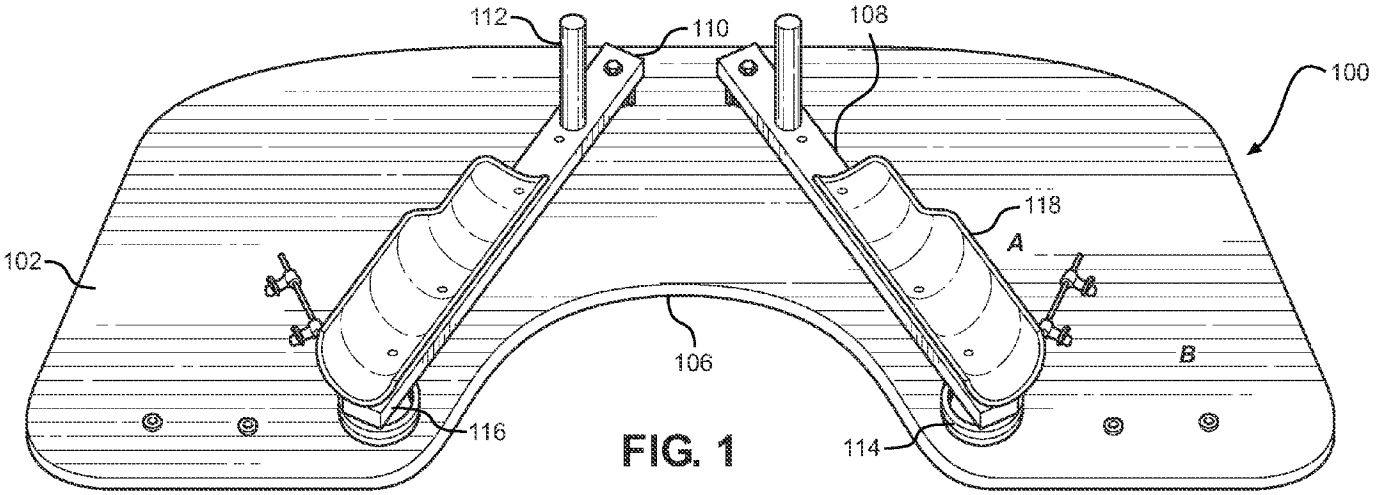
FIG. 1 shows a perspective view of the portable exercise machine providing resistance for outward movement of the arms.

Reference is made herein to the attached drawings. Like reference numerals are used throughout the drawings to depict like or similar elements of the portable exercise machine. For the purposes of presenting a brief and clear description of the present invention, the preferred embodiment will be discussed as used for exercising a user's arms. The figures are intended for representative purposes only and should not be considered to be limiting in any respect.

Figure 2:
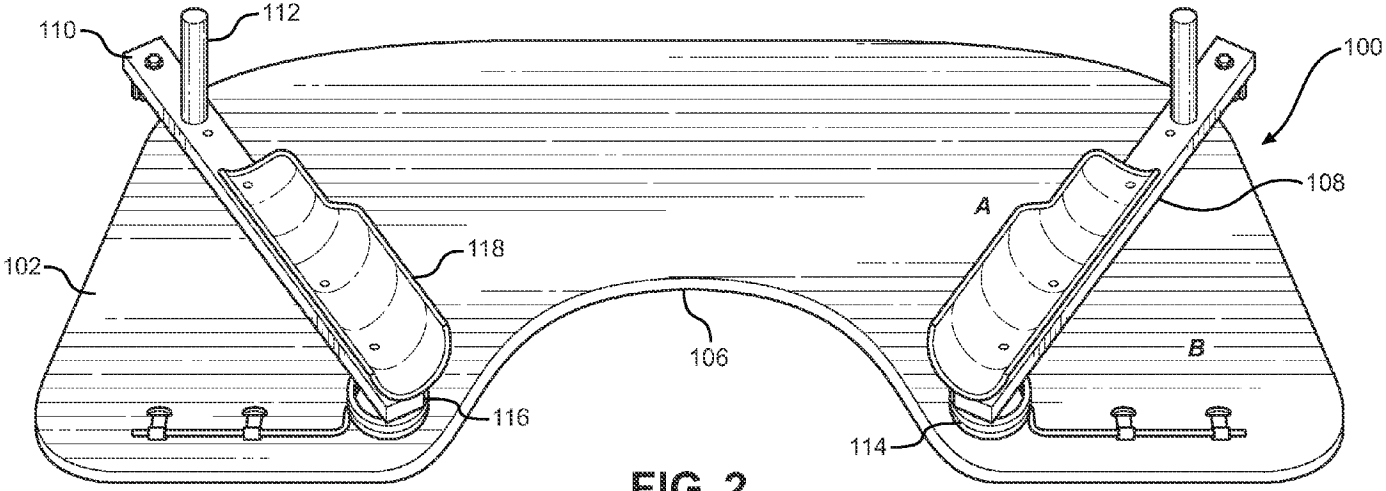
FIG. 2 shows a perspective view of the portable exercise machine providing resistance for inward movement of the arms.

Referring now to FIGS. 1 and 2, there are shown perspective views of the portable exercise machine providing resistance for inward and outward movement of the arms, respectively. The present invention provides an apparatus for exercising, conditioning, and strengthening various hand, wrist, forearm, and rotator cuff muscles. The portable exercise machine 100 comprises a pair of arms 108 that provide resistance when a user rotates the arms in an inward or outward motion. The exercise primarily serves to strengthen the rotator cuff muscles by providing resistance for inward and outward movement. The portable exercise machine 100 comprises a flat board 102 that is substantially rectangular in configuration. The flat board 102 includes a U-shaped cutout 106 that is adapted to receive the torso of a user. The U-shaped cutout 106 is preferably along the bottom edge of flat board 102 and is centrally positioned thereon.

A proximal end 116 of the each arm 108 is pivotally affixed to the upper surface of the flat board 102 on the bottom edge thereof. The arms 108 include an arm pad 118 configured to receive the forearms of a user. Each arm 108 comprises a proximal end 116 and a distal end 110. The distal end 110 includes a handle 112 adapted to be grasped by a user. The proximal end 116 of each arm 108 is coupled to a steel coil 114. The steel coil 114 is a circular coil which has two ends, a first end and a second end. The first end of the steel coil 114 is coupled to the proximal end 116 of the each arm 108 and the second end is removably attached to the flat board 102 via a plurality of fasteners. The steel coil 114 is wound around into a circle several times to provide a desired resistance.

Figure 3:
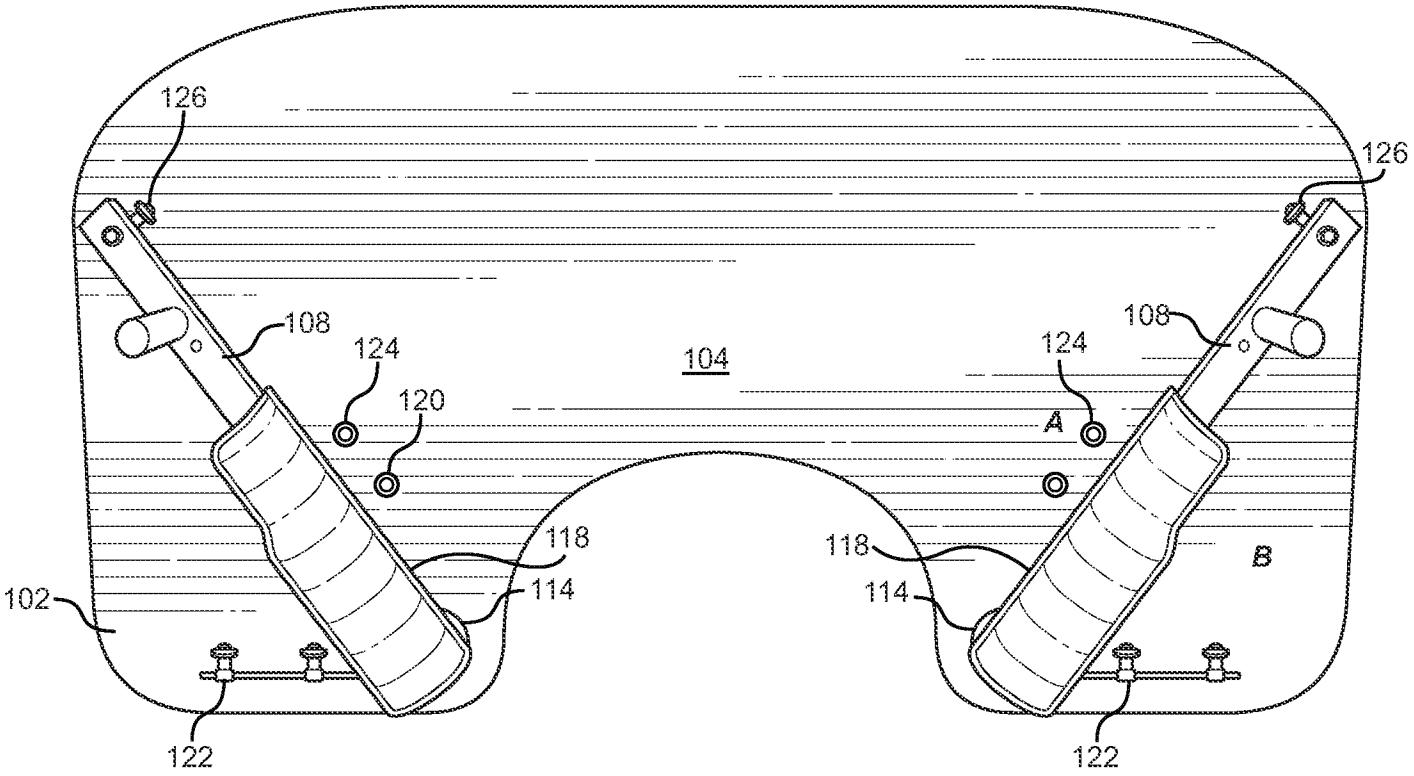
FIG. 3 shows an overhead view of the portable exercise machine.

Referring now to FIG. 3, there is shown an overhead view of the portable exercise machine. The distal end 110 of the arms 108 further comprises a roller assembly 126 including a wheel thereon for allowing the arms 108 to roll across the upper surface 104 of the flat board 102. In some embodiments, the flat board 102 further includes a guide track disposed on the upper surface 104 to allow the roller assembly 126 to rotate in a guided path on the upper surface 104.

The upper surface 104 includes an inner connection region 120 and an outer connection region 122, wherein each connection region 120, 122 comprises a plurality of apertures 124. The apertures 124 are adapted to receive the fasteners disposed on the steel coil 114. The steel coil 114 is removably affixed to the upper surface 104 via a plurality of fasteners, such bolts, screws, and nuts, among others. When the steel coil 114 is affixed to the inner connection region 120, the arms 108 provide resistance against outward movement of the arms. When the steel coil 114 is affixed to the outer connection region 122, the arms 108 provide resistance against inward movement of the arms.

Figure 4:
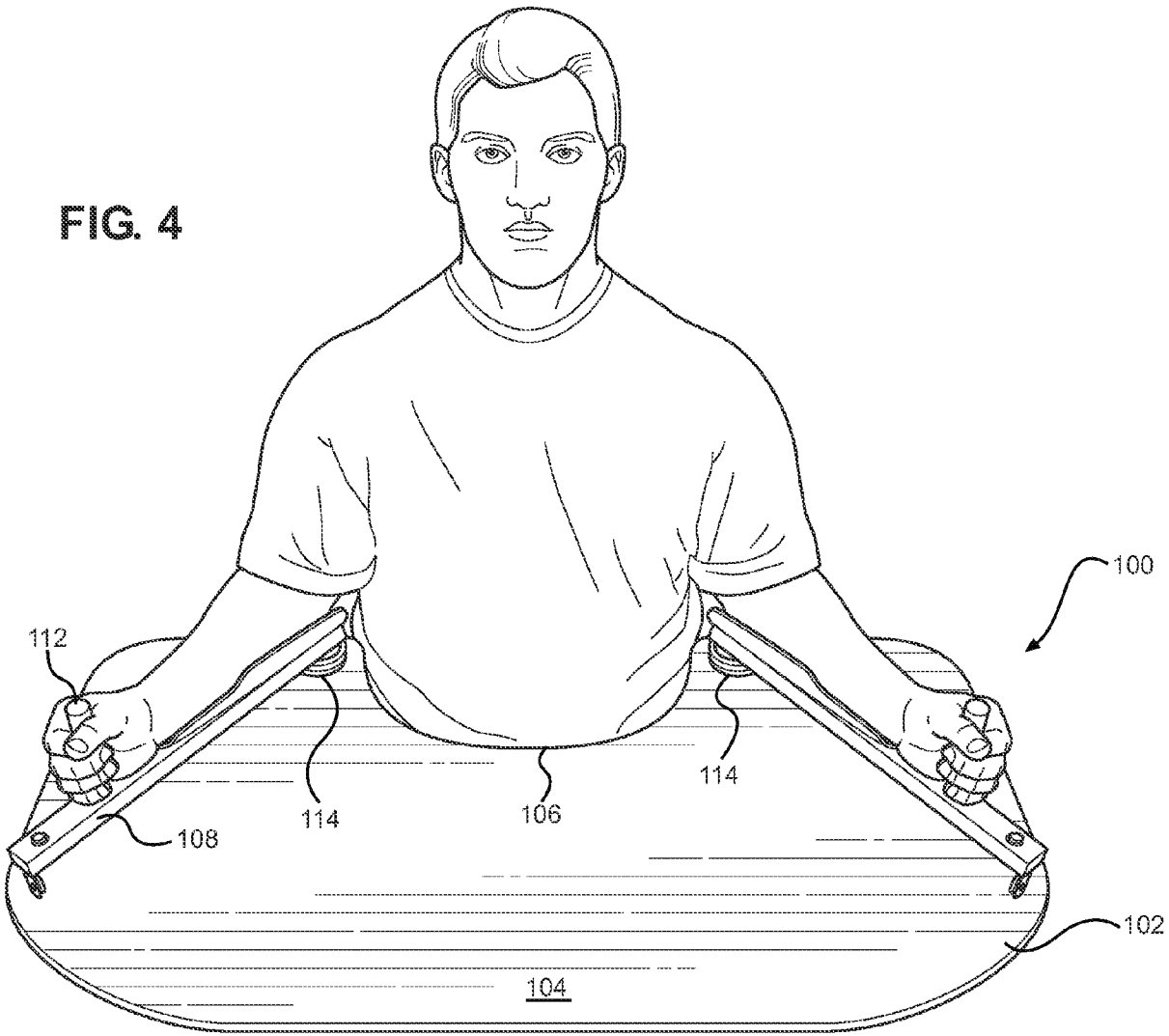
FIG. 4 shows a view of the portable exercise machine in use in a first position.
Figure 5:
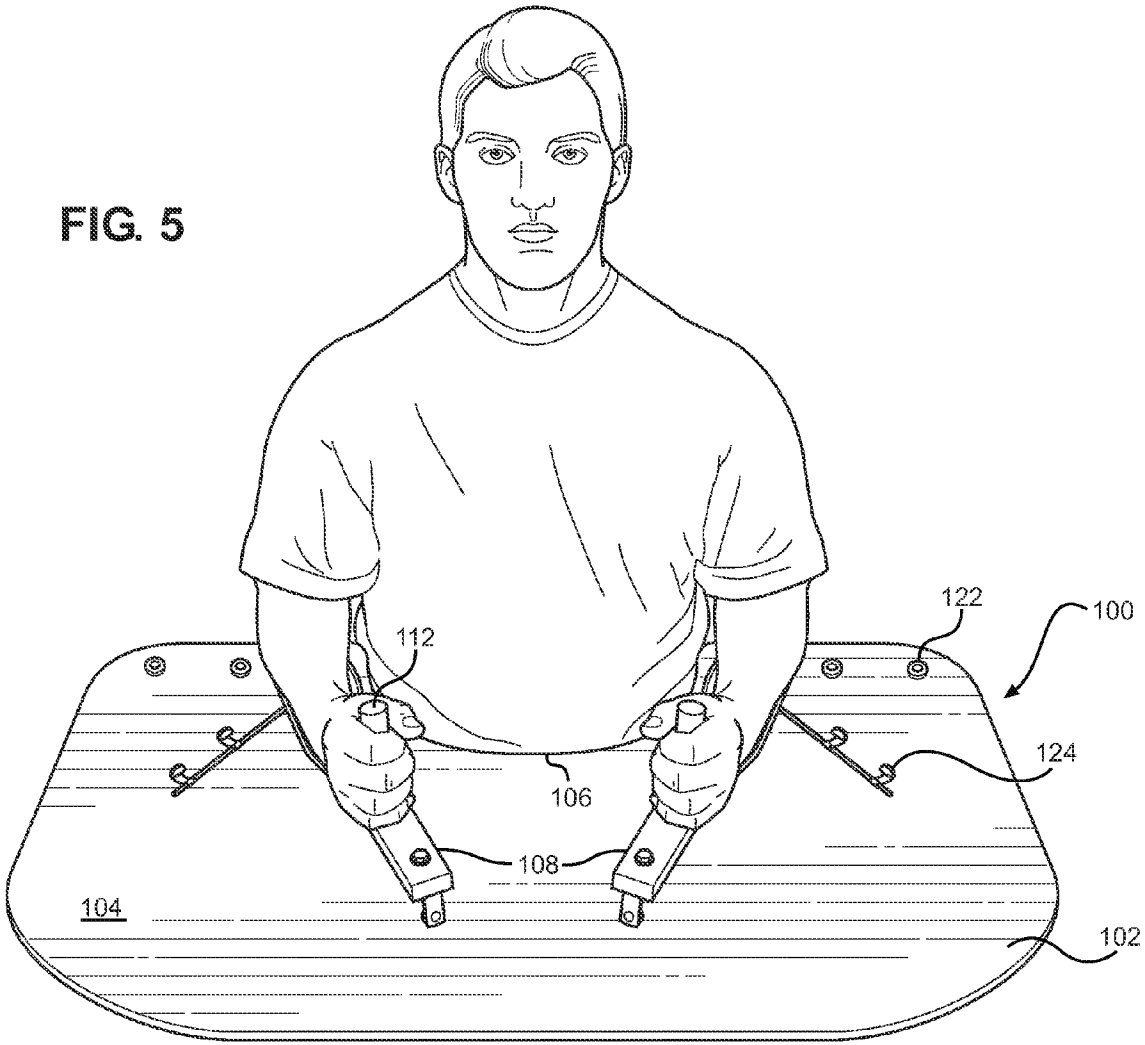
FIG. 5 shows a view of the portable exercise machine in use in a second position.

Referring now to FIGS. 4 and 5, there are shown the portable exercise machine in use. The flat board 102 is positioned so that the U-shaped cutout 106 is flush against the user's torso. The portable exercise machine 100 may be used while the user is in a seated position with the user's arms placed over the arms 108 on the upper surface 104 the flat board 102 and grasping the handles 112 thereon. In this way, the flat board 102 can rest directly atop the user's lap. In a first position, the arms 108 are biased toward each other so that the handles are pointed toward the center of the flat board 102. In this configuration, the arms 108 provide resistance for outward movement, thereby working the front head of the rotator cuff muscle.

The user can rotate the arms 108 of the device into a second position in which the arms 108 are biased away from each other. In the second position, the steel coil 114 is affixed to the outer connection region 122. The arms 108 are biased away from each other towards the outer edges of the flat board 102. In this configuration, the arms 108 provide resistance for inward movement, thereby working the rear head of the rotator cuff muscle.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable exercise machine, comprising:

a flat board having an upper surface and a U-shaped cutout configured for receiving a torso of a user;

a pair of opposing, rotatable arms affixed to the upper surface of the flat board, wherein a distal end of each arm includes a handle; and at least one steel coil coupled to a proximal end of each arm, wherein the proximal end of each arm is secured to the flat board by the steel coil that provides resistance against the rotation of the distal end of the arms.

2. The portable exercise machine of claim 1, wherein each arm includes an arm pad configured to receive forearms of the user.

3. The portable exercise machine of claim 1, wherein each steel coil is affixed to the upper surface via a plurality of fasteners.

4. The portable exercise machine of claim 3, wherein the upper surface further includes an inner connection region and an outer connection region, wherein each connection region is adapted to receive the fasteners of the steel coil.

5. The portable exercise machine of claim 4, wherein the inner connection region provides resistance for outward movement of the arms.

6. The portable exercise machine of claim 4, wherein the outer connection region provides resistance for inward movement of the arms.

7. The portable exercise machine of claim 1, wherein the distal end of each arm further includes a roller assembly.

* * * * *